US008746512B2

(12) United States Patent
Miyamoto et al.

(10) Patent No.: US 8,746,512 B2
(45) Date of Patent: Jun. 10, 2014

(54) SEALING STRUCTURE FOR AEROSOL CONTAINER, AEROSOL CONTAINER AND AEROSOL CONTAINER MANUFACTURING METHOD

(75) Inventors: Hidetoshi Miyamoto, Kyoto (JP); Keiichiro Teramoto, Kyoto (JP); Tatsuya Nakamuro, Ibaraki (JP); Masaomi Takahashi, Ibaraki (JP)

(73) Assignee: Daizo Corporation, Osaka (JP)

( * ) Notice: Subject to any disclaimer, the term of this patent is extended or adjusted under 35 U.S.C. 154(b) by 293 days.

(21) Appl. No.: 13/123,193

(22) PCT Filed: Oct. 8, 2009

(86) PCT No.: PCT/JP2009/067542
§ 371 (c)(1),
(2), (4) Date: Jun. 3, 2011

(87) PCT Pub. No.: WO2010/041709
PCT Pub. Date: Apr. 15, 2010

(65) Prior Publication Data

US 2011/0240682 A1 Oct. 6, 2011

(30) Foreign Application Priority Data

Oct. 9, 2008 (JP) ..... 2008-263292

(51) Int. Cl.
*B65D 83/00* (2006.01)

(52) U.S. Cl.
USPC ..... 222/394; 222/402.1

(58) Field of Classification Search
USPC ..... 222/394, 402.1, 402.11, 402.13, 321.1, 222/321.7, 321.9
See application file for complete search history.

(56) References Cited

U.S. PATENT DOCUMENTS

| | | | | |
|---|---|---|---|---|
| 5,305,925 | A * | 4/1994 | Vogel | 222/147 |
| 5,400,920 | A * | 3/1995 | Barnhart | 222/1 |
| 5,979,714 | A * | 11/1999 | Bleile et al. | 222/402.1 |
| 6,216,922 | B1 * | 4/2001 | Bleile et al. | 222/402.1 |
| 2009/0008584 | A1 | 1/2009 | Fontela et al. | |

FOREIGN PATENT DOCUMENTS

| | | | |
|---|---|---|---|
| JP | 3951045 | B2 | 8/2007 |
| WO | WO-2007/074274 | A1 | 7/2007 |

OTHER PUBLICATIONS

International Search Report for the Application No. PCT/JP2009/067542 mailed Jan. 12, 2010.

* cited by examiner

*Primary Examiner* — Kevin P Shaver
*Assistant Examiner* — Stephanie E Williams
(74) *Attorney, Agent, or Firm* — Cheng Law Group, PLLC

(57) ABSTRACT

A sealing structure which seals a container body and an aerosol valve without providing a seal member between them. An aerosol container employing the seal structure comprises a bottomed cylinder like container body and an aerosol valve firmly fixed to the opening of the container body. The seal structure between the container body of the aerosol container and the aerosol valve is formed of a valve support portion of the container body and a step portion of the aerosol valve. The aerosol container is manufactured by deforming a corner of the step portion into a curved surface shape from a square shape by applying an annular force to the step portion from a convex surface by plastically deforming a lower part of a cover cap and a part of the container body while pushing the cover cap downward.

17 Claims, 10 Drawing Sheets

SEALING STRUCTURE FOR AEROSOL CONTAINER, AEROSOL CONTAINER AND AEROSOL CONTAINER MANUFACTURING METHOD

FIELD OF THE INVENTION

The present invention relates to the sealing structure of an aerosol container, an aerosol container equipped with the sealing structure, and a method for manufacturing the aerosol container.

DESCRIPTION OF THE BACKGROUND

Patent Document 1: Japanese Patent No. 3951045

Conventionally, aerosol containers for filling the concentrate solution such as commonly used hair cosmetics, skincare cosmetics, and antiperspirants, and propellants such as liquefied gas, compressed gas are known. Thus, the aerosol containers used for various applications have recently increased the chance of being carried not only when being at home but also when being away from home. The miniaturization of aerosol containers is desired ardently from such a status.

However, since the aerosol container comprises generally a container body having pressure tightness and an aerosol valve attached to the opening thereof, there are various problems to miniaturize it. For example, since the aerosol container is filled with a content having a pressure higher than atmospheric pressure, it needs a technology of sealing to prevent leaking of the content outside. In order to obtain a sealing property, it is necessary to adjust and manage a seal portion in units of 0.1 mm. If each component is miniaturized, the manufacture of each component, the assembling thereof, and further the inspection thereof becomes difficult.

DESCRIPTION OF THE INVENTION

The applicant of the present invention has developed a compact aerosol container as shown in Patent Document 1. However, the sealing of the container body and the aerosol valve is formed by providing a sealing member made of synthetic rubber etc. on the upper end of the container body. The seal member between the container body and the aerosol valve thus provided easily allows the obtaining of the sealing property, but there may be cases that the seal member is swelled by the contents, or that a plasticizing agent is extracted causing the deterioration of contents. Particularly, it has been found that the problem becomes significant when the amount of contents becomes small.

The present invention is targeted to solve such problems, and to provide an aerosol container which is equipped with a sealing, structure which seals the container without providing a seal member between a container body and an aerosol valve, and a method for manufacturing the aerosol container.

Means of Solving the Problem

The sealing structure of an aerosol container of the present invention, comprises a container body having a cylindrically shaped opening, a tubular housing fixed to the opening, and a cup-shaped cover cap fixed to the container body covering the housing. The housing has an annular step portion, the cover cap has a deformed portion which is inwardly plastically deformed, and the container body has a first portion which comes into contact with the step portion. The sealing structure has a circular seal portion formed between the first portion and the step portion which is formed by deforming the corner portion of the step portion by pressing the first portion, when forming the deformed portion while pushing the cover cap downwardly against the housing.

In such sealing structure it is preferable that the corner portion of the step portion is deformed into a curved surface shape which makes an area contact with the first portion from a square shape which makes line contact with the first portion.

Moreover it is preferable that the housing has a flange portion engaging with an upper end portion of the container body constituting the opening, and the flange portion constituting an upper holding structure clamped between the upper end portion and the inner bottom face of the cover cap.

And the lower face of the flange portion is preferable to be inclined downwardly toward outside.

Meanwhile, it is preferable that the housing has a second step portion situated below the step portion, the container body has a second portion which comes in contact with the second step portion, and the contact of the second step portion and the second portion constitutes a lower holding structure.

It is preferable that the second step portion has a smaller diameter than the step portion, and that the second portion of the container body comes in contact with the surface of the second step portion.

A rib is preferable to be provided annularly on the surface of the second step portion, where the second portion deforms the rib by pressing.

The second step portion is preferable to be a plurality of longitudinal ribs provided annually, where the second portion deforms the longitudinal rib by pressing.

The second portion is preferable to come in contact with the corner portion of the second step portion. And further, the second portion is preferable to deform the corner portion of the second step portion.

A tongue piece extending downward and formed on the inner side than the corner portion of the step portion is preferably provided in the lower surface of the step portion where the corner portion and the tongue piece are deformed by coming in contact with the container body.

A tongue piece extending downward from the corner portion of the step portion is preferably provided, where the tongue piece is deformed by coming in contact with the container body.

A contact line coming in contact with the housing by at least two points is preferable to be constituted so as not to include the step portion. The contact line means a straight line which does not intersect with other than a portion and a point or a line of the housing 21. In this case, it is preferable that the housing has the flange portion engaging with the upper end portion of the container body constituting the opening, and that a side surface of the housing has a protrusion protruding outwardly in a radial direction, where the protrusion constitute a contact line with a lower end periphery of the flange portion.

The sealing structure of the present invention is preferable to be provided with a synthetic resin layer at least on the inside face of the opening of the container body, and the housing is preferable to be made of polyolefin.

The aerosol container of the present invention equipped with the sealing structure of the present invention comprises, the container body and an aerosol valve fixed to the opening thereof. The aerosol valve has the housing, a stem housed in the housing with free vertical movement, a spring which always energizes the stem upward, a stem rubber which plugs the stem hole of the stern, and the cover cap.

In the method for manufacturing the aerosol container of the present invention, comprises the steps of deforming the corner of the step portion into a curved surface shape from a square shape, by applying a force annually to the step portion from a convex surface by plastically deforming the lower part of the cover cap and a part of the container body while pushing the cover cap downwardly.

It is preferable that the housing has an annular second step portion beneath the step portion, and comprises the step of forming the lower holding structure between the second portion and the second step portion of the container body, simultaneously with the plastic deformation of the step portion.

Effect of the Invention

In the sealing structure of the aerosol container of the present invention, the housing has an annular step portion, the cover cap has a deformed portion which is plastically deformed inwardly, and the container body has a first portion which comes into contact with the step portion, and the above described sealing structure is formed by press-deforming the step portion with the first portion, when forming the deformed portion while the cover cap is pushed downward against the housing. Therefore, it is possible to seal contents having an inner pressure without using a seal member. In the present invention, since the step portion of the housing is made to deform daringly when fixing a valve to the container body, it is possible to seal surely, even if some deformations occur in the shape of plastic deformation and in the position of the plastic deformation, which serves as a manufacturable configuration in a production process. Moreover, the contact of the first portion and the step portion has also a holding action of the housing in a radial direction and in a vertical direction.

In such sealing structure of the aerosol container, in the case that the corner portion of the step portion is press-deformed into a curved surface shape making an area contact with the first portion of the container body from a square shape, the deformation of the step portion can be securely performed also in the production process.

In the sealing structure of the present invention, since the housing has a flange portion engaging with an upper end portion of the container body constituting the opening, and the flange portion constituting an upper holding structure clamped between the upper end portion and the inner bottom face of the cover cap, the housing is clamped in a vertical direction from above and below of the cover cap and the container body, being stable with regard to the vertical direction. As the result, even if an accidental external force etc. such as a shock is applied to the aerosol container by dropping down, or being hit against some thing, the housing will not move and become out of alignment, and the seal portion will not become out of alignment. In addition, in this investigation, it is found that a seal member used in conventional aerosol containers not only seals between the aerosol container, but also acts to absorb external forces applied to the housing, and that if the seal member is omitted, the housing becomes out of alignment by the external force, and the sealing property can be easily deteriorated. Moreover, the upper holding structure has a sealing property by the contact of the upper end of the container and the lower face of the housing (upper seal portion). Since this configuration has two seal places of a seal portion and an upper seal portion, and further has the upper holding structure, the sealing property and the stability of the sealing are high.

And, in the case that the lower face of the flange portion inclines downward toward outside, the contact area of the upper end portion of the container and the flange portion becomes large, and further the force received mutually by the contact portions becomes large, resultantly the sealing property of the upper seal portion can be improved.

In the case that the housing has a second step portion situated below the step portion, the container body has a second portion which comes in contact with the second step portion, and that the contact of the second step portion and the second portion constitutes a lower holding structure, the alignment of the housing is even harder to break up, since the support in a plane direction is improved by the lower holding structure, even if the housing receives an external force.

In the case that the second step portion is of smaller diameter than the step portion, and the second portion of the container body comes in contact with the surface of the second step portion, the side face of the housing comes in contact with the container body at two places, which increases the stability of the housing. Particularly, in the case that the diameter of the second step portion is smaller than that of the step portion, and that the second step portion of the container body comes in contact with the surface of the second step portion, it becomes easy to form the step portion into a predetermined shape, because the second step portion works as a supporting pedestal of a jig such as a clamping claw, a roller when forming the deformed portion.

In the case that a rib is provided annularly in the surface of the second step portion, and the second portion press-deforming the rib, not only the support in a horizontal direction, the sealing effect between the second portion and the rib is easy to be obtained (lower seal portion). In this case, since at least two seal portions are equipped between the container body and the housing, the whole sealing property is further improved.

In the case that the second step portion is a plurality of longitudinal ribs annularly provided, and that the second portion press-deforms the longitudinal rib, the step portion can be securely deformed into a predetermined shape, because the front edge of a clamping claw and a roller can be moved to a predetermined position when in the plastic deformation.

Further, the longitudinal rib can absorbs the force applied during the strong contact of the clamping claw and the roller while forming the deformation portion, which avoid the contraction of the housing body and prevents the stem to become out of action.

In the case that the second portion comes in contact with the corner portion of the second step portion, the housing further becomes out of alignment, since the housing is held not only in the horizontal direction but also in the vertical direction. Further, in the case that the second portion press-deforms the corner portion of the second step portion, the sealing property can be obtained between the second portion and the second step portion (lower seal portion). And the whole sealing property is further improved and the housing is fixed stably, since at least two seal portions are equipped between the container body and the housing.

In the case that, a tongue piece extending downward and formed on an inner side than the corner portion of the step portion is provided, and that the corner portion and the tongue piece are deformed by coming in contact with the container body, the sealing effect is obtained between the container body and the corner portion, and between the container body and the tongue piece.

In the case that, the tongue piece extending downward from the corner portion of the step portion is provided, and that the tongue piece is deformed by coming in contact with the container body, a high sealing property can be obtained, since the tongue piece comes in contact with container body at a broad area from the side face of the step portion to the tongue piece.

In the case that the contact line coming in contact with the housing by at least two points is constituted so as not to include the step portion, even if the housing rolls over in delivery etc., the step portion will not contact to the floor etc., and the shape of the step portion can be protected.

In the case that the housing has the flange portion engaging with the upper end portion of the container body constituting the opening, and a side surface of the housing has a protrusion protruding outwardly in a radial direction, and the protrusion constitute a contact line with the lower end periphery of the flange portion, the step portion can be protected regardless of the shape of the aerosol container.

In the case that a synthetic resin layer is provided at least on the inside face of the opening of the container body, the sealing property can be obtained between the synthetic resin layer and the housing. Particularly, if irregularity is generated in the inner face when forming the opening of the container body, a gap tends to occur between the housing and the inner face causing the deterioration of the sealing property. But by providing the synthetic resin layer, it is possible to make the inner face to be a uniform face, maintaining a high sealing property.

In the case that the housing is made of polyolefin, since it is softer compared with polyamide (nylon), polyoxymethylene (DURAKON), polybutylene terephthalate, which are conventionally used, further high sealing property can be obtained between the step portion of the housing and a part of the container body.

An aerosol container of the present invention comprises the container body and an aerosol valve fixed to the opening thereof, in which the aerosol valve comprises the housing, a stem housed in the housing with free vertical movement, a spring which always energizes the stem upward, a stem rubber which plugs the stem hole of the stem, and the cover cap, it is possible to supply a stable product without providing the seal member, since being it is equipped with the sealing structure of the present invention. Particularly, it is preferable as a small or compact aerosol container.

In the method for manufacturing the aerosol container of the present invention, while the cover cap is pushed downward, the lower part of the cover cap and a part of the container body are plastic deformed inward, simultaneously a force is applied annularly to the step portion by a convex surface, deforming the corner of the step portion into a curved surface shape from a square shape, thereby the seal effect can be applied securely between the step portion and a part of the container body.

In the case that the housing has an annular second step portion beneath the step portion, and that simultaneously with the plastic deformation, the lower holding structure is formed between the second portion and the second step portion of the container body, a further stable aerosol container can be manufactured.

BRIEF DESCRIPTION OF DRAWING

The sealing structure and the aerosol container equipped with the sealing structure of the present invention are described herein referring to drawings.

BEST MODE FOR CARRYING OUT THE INVENTION

Figure 1:
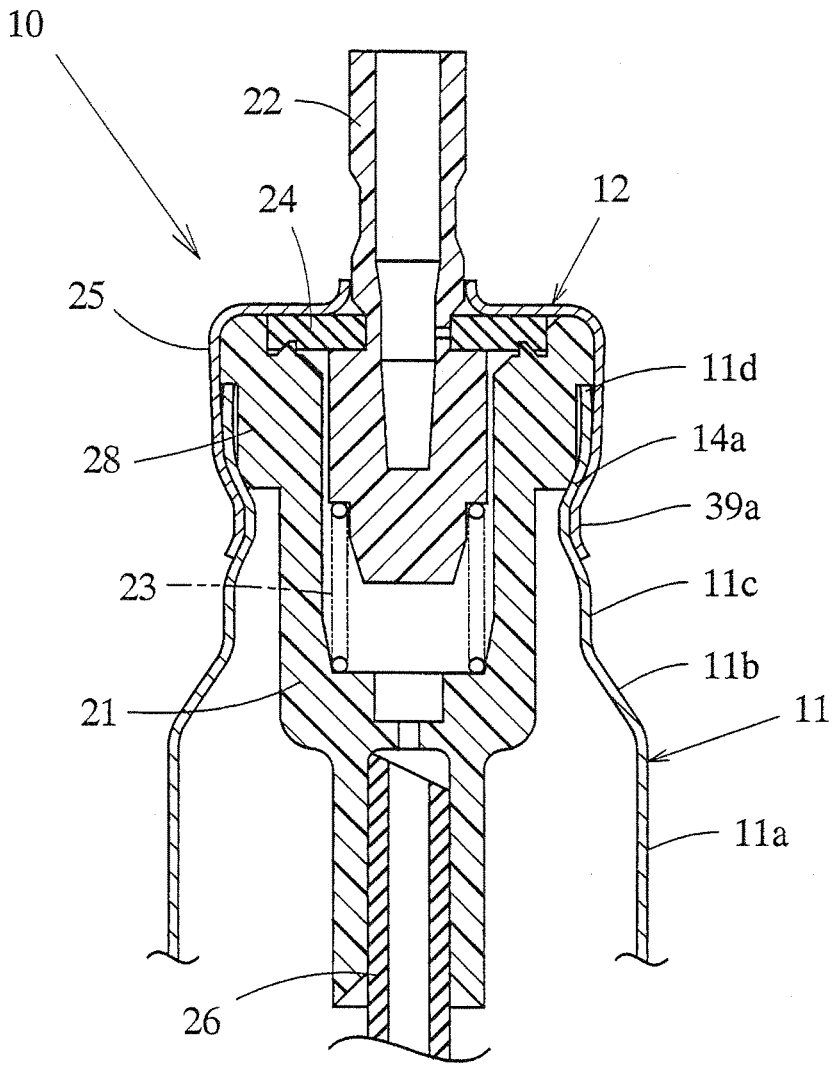
FIG. 1 is a partial side cross sectional view showing an embodiment of the aerosol container of the present invention.

First, an aerosol container 10 manufactured by using the sealing structure of the present invention is described using FIG. 1.

The aerosol container 10 comprises a tubular bottomed container body 11 and an aerosol valve 12 firmly fixed to the opening of the container body. The seal between the aerosol container body 11 and the aerosol valve 12 is formed by a valve support portion 14 of the container body and a step portion 28 of the aerosol valve. And, a conventionally used elastic material such as synthetic rubber for sealing between the container body 11 and the aerosol valve 12 is not equipped.

The container body 11 has pressure resistance comprising a bottom portion (not shown in the figure), a barrel portion 11*a*, a shoulder portion 11*b*, and a neck portion lie, in which the upper end 11*d* of the neck portion forms the opening. Moreover, in the neck portion 11*c*, a valve support portion 14 protruding inward to support the valve is annularly formed.

This container body 11 is an integrated body in which a tubular body is formed by impact forming from a metal plate such as aluminum. After that, the shoulder portion and the neck portion are formed by applying necking processing to the upper portion thereof. Moreover, a synthetic resin layer of polyamide-imide, epoxyphenol etc. is provided in the inner surface of the container body. Particularly, a synthetic resin layer of the thickness 3-30 μm, preferably 5-25 μm is formed at least in the inner surface of the opening.

The size of the container 11 is 10-25 mm in the diameter of the barrel portion 11*a*, preferably 12-20 mm, and is 8-20 mm in the diameter of the neck portion 11*c*, preferably 10-18 mm. Moreover, the thickness of the container body is 0.3-1.0 mm, preferably, 0.5-0.9 mm.

The aerosol valve 12 comprises a tubular housing 21, a stem 22 housed in the housing in a state being freely movable vertically, a spring 23 energizing the stem upward always, a stem rubber 24 plugging the stem hole of the stem, and a cup-like cover cap 25 which covers the upper portion of the housing 21 and is fixed to the container body 11. And, a dip tube 26 is attached to the lower end of the housing 21 of the aerosol valve.

Figure 2A:
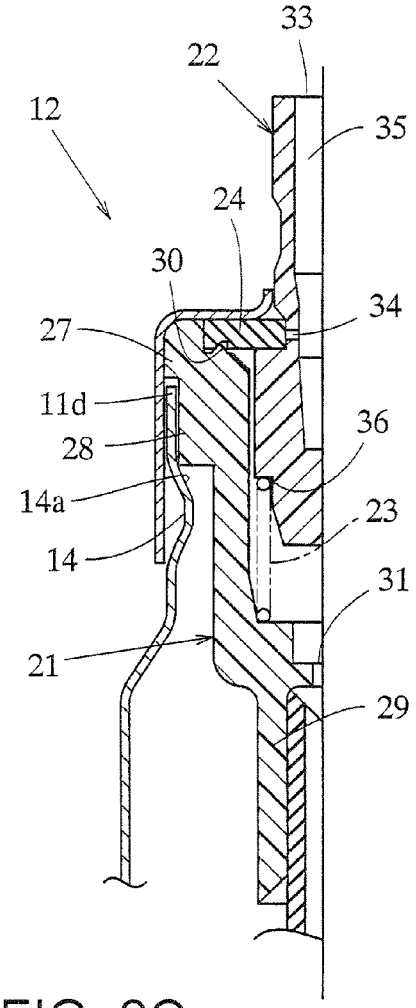
FIGS. 2*a, b* are partial side cross sectional views of showing before and after crimping of the cover cap of FIG. 1.

In the housing 21, an annular flange portion 27 is formed in an upper periphery, an annular step portion 28 becoming smaller in diameter downward is formed beneath thereof, and a tube attaching portion 29 is formed in a bottom outside face, as shown in FIG. 2*a*. The tube attaching portion 29 is tubular portion protruding from a lower face of the bottom of the housing 21. Moreover, in the upper end of the housing 21, a stem rubber holding portion 30 recessed inward is formed, and a communicating hole 31 which communicates with the tube attaching portion 29 is formed in the bottom center.

As such a housing, polyamide (nylon), polyacetal (DURAKON), polybutylene terephthalate etc. are used. However, to improve sealing property, polyolefin, particularly, polyethylene, polypropylene may be used.

The stem 22 is a tubular member, which comprises an upper portion of which has a spout 33 equipped with the opening in the upper end, which has a stem hole 34 formed in the side face, which has an internal path 35 communicating with the spout 33 and the stem hole 34, and a lower portion where a spring engaging portion 36 to engage with the upper end of the spring 23 is formed.

The spring 23 is held by the spring engaging portion 36 of the stern 22 and the bottom of the housing, energizing the stem 22 upward.

The stem rubber 24 is that which is ring-like, housed in a stem rubber holding portion 30, and held between the stem rubber holding portion 30 and the inside of an upper bottom portion of the cover cap. In the center hole, the stem 22 is inserted. The up/down movement of the stem opens and closes the stem hole 34.

Figure 2B:
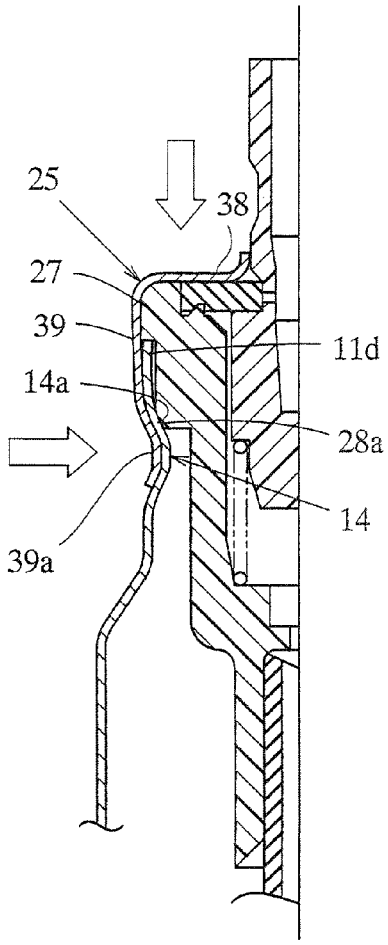
FIG. 2*c* is an extended figure thereof.

As shown in FIG. 2*b*, the cover cap 25 comprises an upper bottom portion 38 and a side wall portion 39 extending downward from the periphery of the upper bottom portion, and a center hole to pass the stem 22 is formed in the upper bottom portion 38. Moreover, the whole of the aerosol container 12 is firmly fixed to the container body 11 by deforming (plastic deforming) the lower portion 39*a* (deformed portion) of the side wall portion 39 with a crimping claw or a roller in the direction of the container body.

The aerosol container 10 of the present invention is manufactured as follows. First, as shown in FIG. 2*a*, the aerosol valve 12 is inserted into the opening of the aerosol container 11. On this occasion, the step portion 28 of the housing comes in contact with the inside face of the valve support portion 14 of the container body, and supports the aerosol valve 12. More specifically, the upper end 11*d* of neck portion of the container body slightly comes in contact with the flange portion 27 of the housing, or the flange portion 27 is located slightly upper than the upper end 11*d* of neck portion. After that, as shown in FIG. 2*b*, the cover cap 25 is pressed downward (arrow head direction). Simultaneously, the lower portion 39*a* of the cover cap 25 is deformed (plastically deformed) toward the container body side (arrow head direction) by the crimping claw etc.

On this occasion, an upper inclined plane 14*a* (the first portion) of the inside face of the valve support portion 14 of the container body presses a corner portion 28*a* of the step portion 28, and deforms the corner portion 28*a* of the step portion 28 into a curved surface shape. Moreover, the valve support portion 14 of the container body plastically deforms slightly together with the plastic deformation of the lower portion 39*a* of the cover cap. Further, since the cover cap 25 is plastically deformed by being strongly pressed downward, the upper end 11*d* of the neck portion of the container body and the flange portion 27 of the housing strongly come in contact.

Figure 2C:
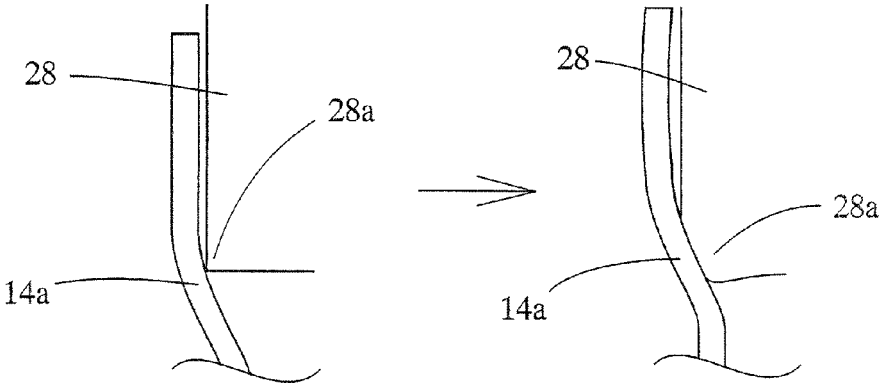

As shown in FIG. 2*c*, by deforming the corner portion 28*a* of the step portion 28 into the curved surface shape at the inside face of the upper inclined plane 14*a* of the valve support portion, the contact portion of the corner portion 28*a* and the valve support portion 14 become a plane from a line. Particularly, since the corner portion 28*a* deforms according to the shape of the valve support portion 14, a strong seal (seal portion) is annularly formed between the corner portion 28*a* of the step portion 28 and the upper inclined plane 14*a* of the valve support portion 14. Hence, the aerosol container 10 can seal up a content (aerosol composition) having a vapor pressure of 0.2-0.8 MPa, even if a conventional seal member is omitted. In addition, there is a space under the lower face of the step portion 28, the corner portion 28*a* can somewhat deforms downwardly, which prevents the step portion 28 from cracking caused by a force applied.

The step portion 28 may be made into a curved surface shape from the beginning, if it can be deformed in the process to plastic deform of the cover cap (valve attaching process). But it is preferable to be a cornered shape from the point that it is easily deformed according to the front edge shape of a crimp claw and a roller, and that it is easy to obtain a high sealing property.

Meanwhile, an upper seal portion is formed annularly between the upper end 11*d* of the neck portion of the container body and the flange portion 27 of the housing. This upper seal portion is not as strong as the seal between the step portion 28 and the valve support portion 14. However, regardless that it is configured so that the length from the valve support portion 14 of the container body to the upper end 11*d* of the neck portion is somewhat longer than the length from the flange portion 27 of the housing to the corner portion 28*a*, in a state of the manufactured aerosol container 10, they contact strongly. Hence an annular line seal structure can be obtained between the upper end 11*d* of the neck portion and the flange portion 27. In this case where the material of the flange portion is comparatively soft, the upper end 11*d* of the neck portion cuts into the flange portion 27 forming a seal. On the other hand, in the case where the flange portion is sufficiently hard, the portion of the container body from the valve supporting 14 to the upper end 11*d* of the neck portion somewhat deforms elastically outward. Therefore the state where the upper end 11*d* of the neck portion strongly pushes the flange portion 27 is form and enhances a sealing force by the contact.

Moreover, the housing 21 is sandwichedly pressed from upper and lower directions of the inner face of the upper bottom portion of the cover cap and the upper end 11*d* of the neck portion at the annular flange portion 27, interdependently with an elastic sandwiching pressure by the curved portion. The housing 21 is stably fixed with regard to the upper and lower directions (upper holding structure). Hence, the seal is maintained although an upward force is applied to the housing by an inner pressure. And the alignment of the housing 21 from the opening of the container body The fear of becoming out of alignment of the housing 21 from the opening of the container body is small, although the aerosol container 10 receives a force from outside.

Figure 3A:
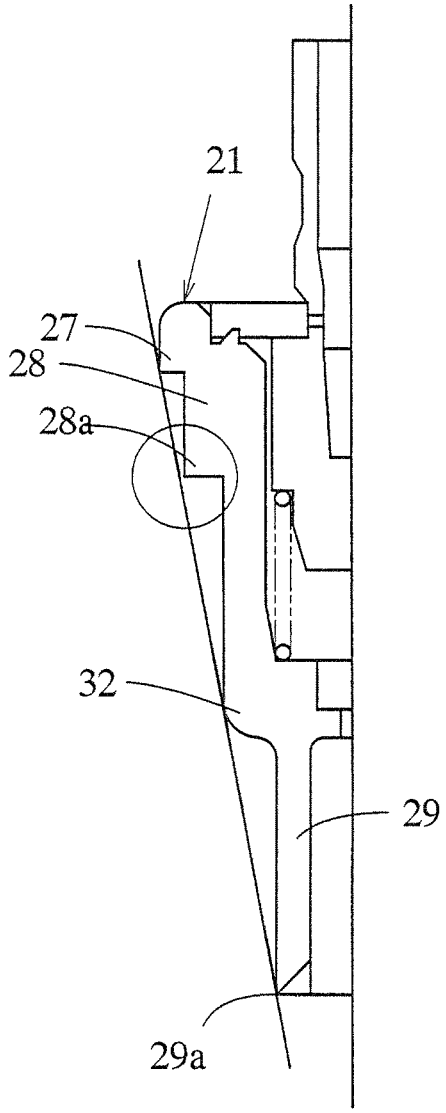
FIG. 3*a* is a drawing showing the relation between the aerosol container and the contact line.

As described above, in order to maintain the shape of the corner portion 28*a* of the step portion 28, until the aerosol container is manufactured, for example, it is preferable to have a protecting means to protect the step portion against an external force to be received by transportation etc. As a means to protect, for example, the housing 21 is constituted so that the corner portion 28*a* is not included more outside than the contact line connecting the two points of the housing. Here the contact line means a straight line not intersecting with other than a point or a line of the portion of the housing 21. More specifically, in the housing 21 of the aerosol container 10, as shown in FIG. 3, the corner portion 28*a* in the circled portion of FIG. 3*a* is arranged more inside than a contact line connecting the lower end periphery of the flange portion 27 of the housing, the lower end periphery 32 of the housing, and the lower end periphery 29*a* of the tube attaching portion.

Figure 3B:
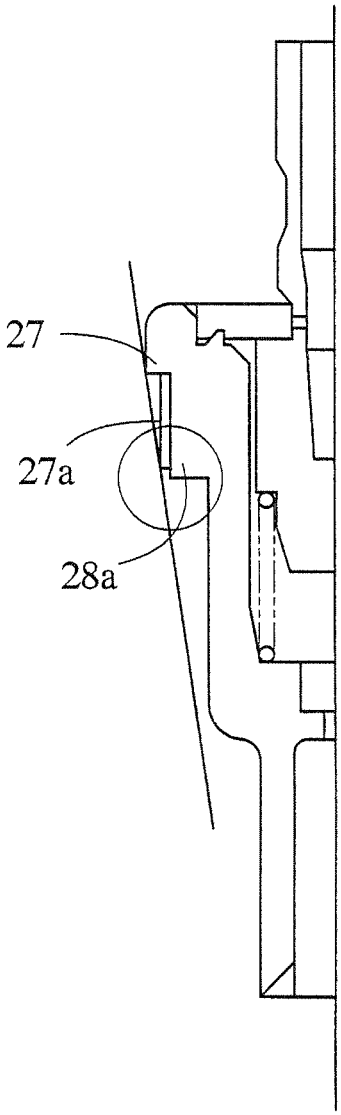
FIG. 3*b* is a drawing showing the relation between the other embodiment of the aerosol container of the present invention and the contact line.

Moreover, as shown in FIG. 3*b*, a plurality of ribs 27*a* extending vertically on the step portion 28 may be laid side by side annularly. In this case, the contact line becomes a line connecting the lower end periphery of the flange portion 27 and the lower end of the rib 27*a*, and the corner portion 28*a* of the step portion 28 in the circled portion of FIG. 3*b* will be arranged inside of the contact line.

Since, the step portion 28 is thus arranged more inside than the contact line which makes the lower end periphery of the flange portion 27 to be one point, the step portion 28 will not contact the floor etc., and the shape of the corner portion 28*a* of the step portion 28*a* will be protected, even if the housing 12 happens to turn over during transportation.

Figure 4A:
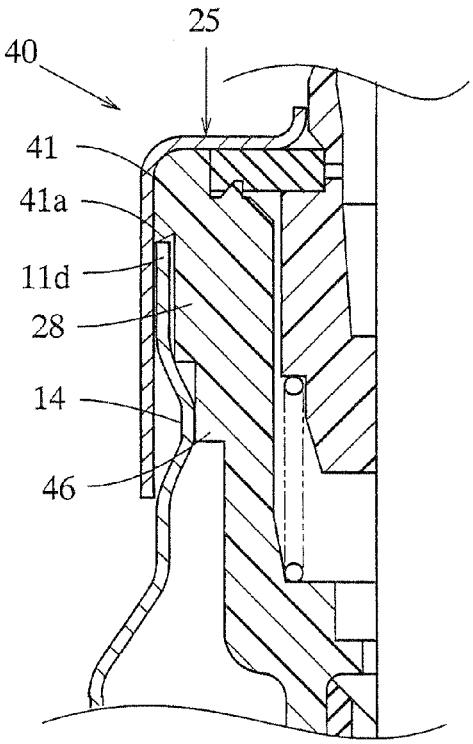
FIGS. 4*a, b* are partial side cross sectional views showing further the other embodiment of the aerosol container of the present invention.

Next, An aerosol container 40 of FIG. 4*a* is that in which the lower face 41*a* of the flange portion 41 of the housing inclines downward in an outward direction.

Figure 4B:
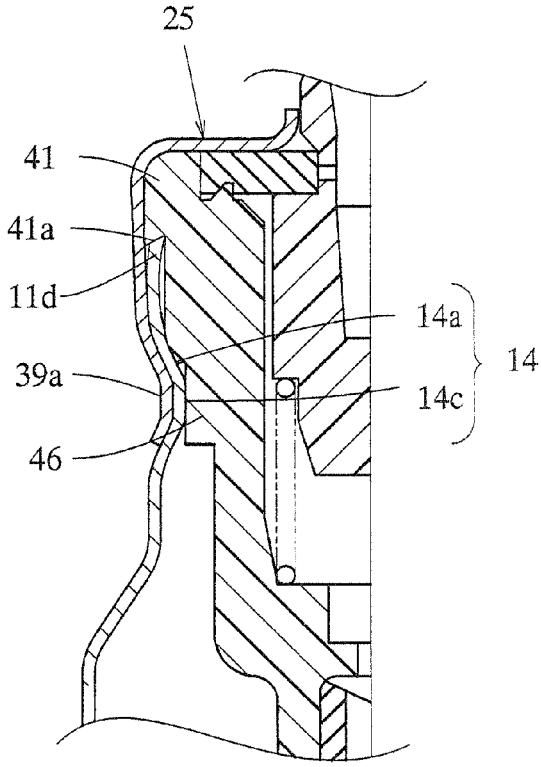

By forming a flange portion 41 of the housing thus, when the lower end 39*a* of the cover cap is plastic deformed inwardly while pushing the cover cap 25 downward, the contact between the upper end 11*d* of the neck portion and the lower face 41*a* of the flange portion 41 becomes firm, enhancing the sealing property of the upper seal portion (FIG. 4*b*). In other words, the upper end lid of the neck portion further cuts into the lower face 41*a* of the flange portion 41, or the portion from the valve support portion 14 of the container body to the upper neck portion 11*d* further bends.

Moreover, the aerosol container 40 of FIG. 4*a* is provided with a lower step portion 46 (second step portion) below the step portion 28 of the housing.

In the aerosol container 40, the top face 14*c* (the second portion of the container body) of the valve support portion and the outer surface 47 of the lower step portion 46 comes in contact, by plastic deforming the lower portion 39*a* of the cover cap. Thereby, it is further stably fixed, since the housing 12 is fixed (lower holding structure) not only by being pressed from the vertical direction pressure of the cover cap 25 and the upper neck portion 11*d* of the container body by the upper holding structure, but also from the side face (lower holding structure), it is further stably fixed. Moreover, in this case, a sealing effect can be also expected according to the degree of plastic deformation of the valve support portion 14.

Moreover, the low step portion 46 may be shaped into a plurality of longitudinal ribs annularly provided. In this case, the low step portion 46 is easy to be deformed by the plastic deformation of the valve support portion.

And, although the sealing property cannot be obtained, since the second step portion deforms together with the plastic deformation of valve support portion, the housing can be further stably fixed. This is because, if the distance of the radial direction between the step portion 28 and the lower step portion 46 is short, there is a fear that the crimp claw receives a counteracting force from the lower step portion 46, which causes an insufficient crimping. However, by making the lower step portion 46 to be a longitudinal rib shape, the lower step portion 46 will deform making it easy for the crimp claw to reach a predetermined position. Thereby, the deforming of the corner portion 28*a* of the step portion will be secured, and the sealing property will be stabilized.

Figure 5A:
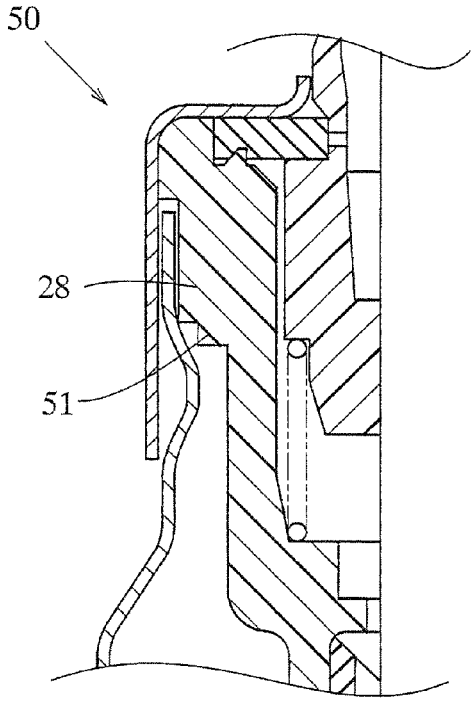
FIGS. 5*a, b* are partial side cross sectional views showing further the other embodiment of the aerosol container of the present invention.

An aerosol container 50 of FIG. 5*a* is that in which a small step portion 51 (second step portion) coming in contact with the valve support portion 14 is provided below the step portion 28 of the housing. Particularly, the small step portion 51 is provided so that its position comes in contact with the upper inclined plane 14*a* of the valve support portion 14. In this embodiment, it means that the first portion and the second portion of the container body are equipped in the upper inclined plane 14*a*.

Figure 5B:
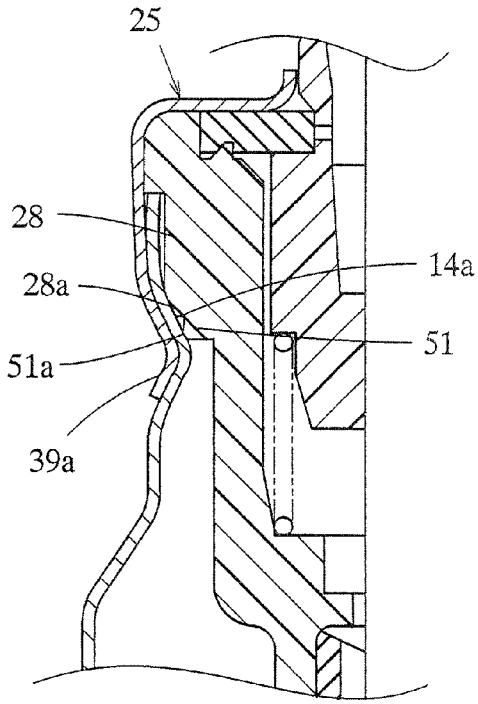
FIGS. 5*c, d, e* are extended figures showing further the other embodiment of the aerosol container of the present invention.

In this aerosol container 50, as shown in FIG. 5*b*, the different portion (the first portion and the second portion) of the upper inclined plane 14*a* of the inside of the valve support portion 14 of the container body depresses the step portion 28 and the small step portion 51 and deform the corner portion 28*a* of the step portion 28 and the corner portion 51*a* of the small step portion 51 into a curved surface shape, when plastic deforming the lower portion 39*a* of the cover cap. Thereby, in the step portion 28 and the small step portion 51 of the housing, a surface contact (seal portion and lower seal portion) with the valve support portion 14 of the container body can be obtained, which further enhances the sealing property. Moreover, In the housing 21, at least two points of the step portion 28 and the small step portion 51 contact with the container body, enhancing the stability.

Figure 5C:
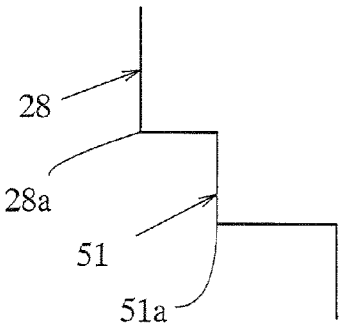
Figure 5D:
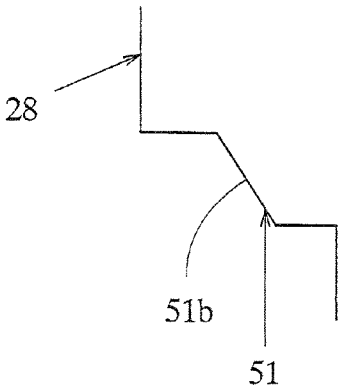
Figure 5E:
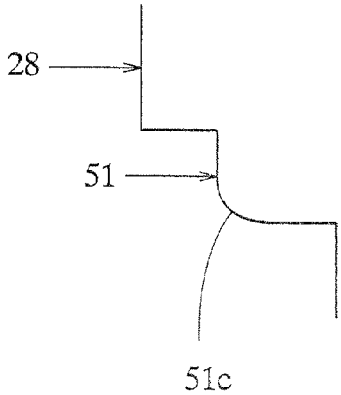

FIGS. 5*c, d, e* show the shape of the small step portion of the housing before manufacturing the aerosol container 50. The small step portion 51 of FIG. 5*c* is an enlarged view of a part of FIG. 5*b*, in which the corner portion 51*a* is substantially a right angle so as to form a stairway shape with the step portion 28 and the small step portion 51. The small step portion 51 of FIG. 5*d* is equipped with an inclined plane 51*b* so as to be along the upper inclined plane 14*a* of the valve support portion of the container body. The small step portion 51*c* of FIG. 5*e* is equipped with a bended portion 51*b* which is bended not having the corner portion.

In each case, the corner portion 51*a*, the inclined plane 51*b*, the bended portion 51*c* and the valve support portion forms the surface contact constituting the sealing structure, when in plastic deformation of the lower portion 39*a* of the cover cap.

Figure 6A:
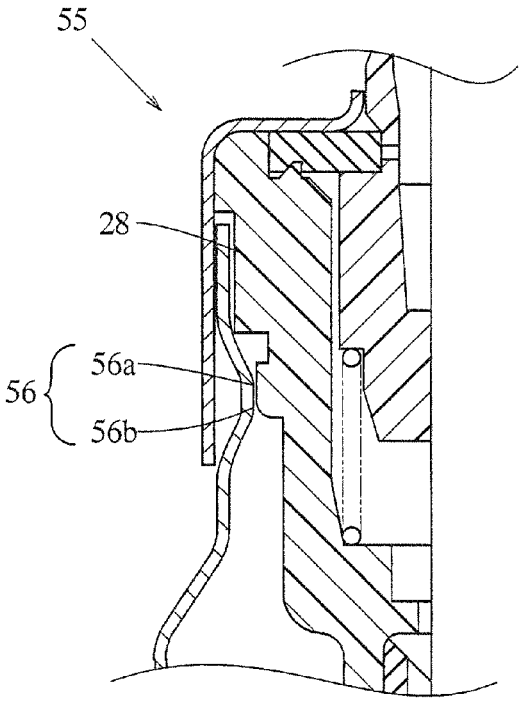
FIGS. 6*a, b* are partial side cross sectional views showing before and after crimping of the other embodiment of the aerosol container of the present invention.
Figure 6B:
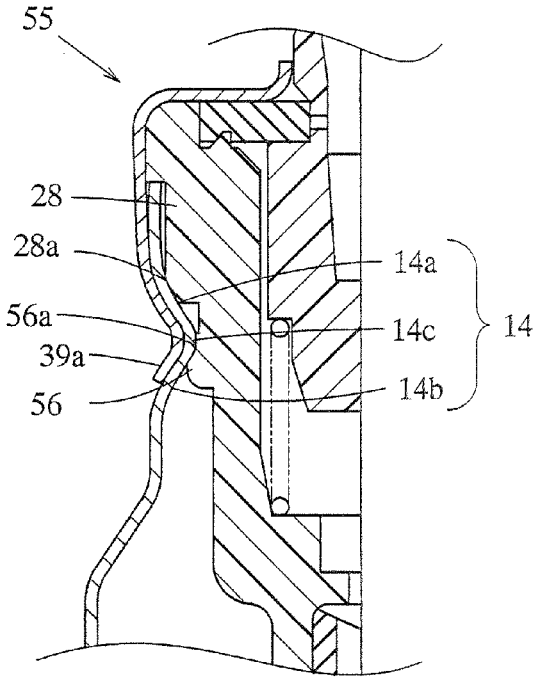

An aerosol container 55 of FIGS. 6*a*, 6*b* is equipped with an annular protruding portion 56 (the second step portion) having an upward step portion 56*a* and a downward step portion 56*b* below the step portion 28.

Since this aerosol container 55 is constituted so that a substantially top or top face of the valve support portion 14 comes to the annular groove portion formed between the step portion 28 and the protruding portion 56, as shown in FIG. 6*b*. Therefore, when the lower portion 39*a* of the cover cap is plastic deformed toward the container body side, the corner portion 28*a* of the step portion 28 surface-contacts with the upper inclined plane 14*a* (the first portion), and the upper step portion 56*a* of the protruding portion surface-contacts with the lower inclined plane 14*b* (the second portion) of the valve support portion. In other words, the corner portion 28*a* of the step portion 28 and the corner portion 56*c* of the upper step portion 56*a* are deformed. And two sealing structures (seal portion and lower seal portion) are formed with the valve support portion 14, enhancing the whole sealing property, by plastic deforming thus the lower portion 39*a* of the cover cap. Further, since this sealing structure becomes a shape in which a wedge is provided in the outer periphery of barrel portion of the housing, the container body serves as a structure to hold the housing vertically and horizontally, preventing the housing from becoming out of alignment when shocks are applied to the aerosol container.

Figure 7A:
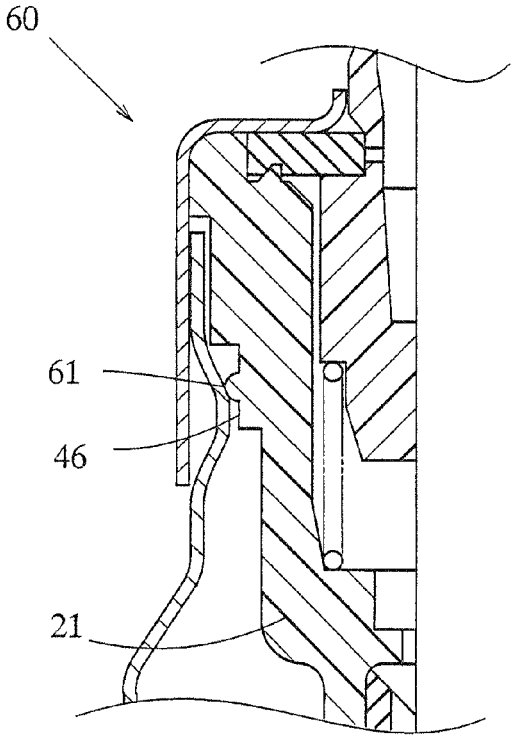
FIGS. 7*a, b* are partial side cross sectional views showing before and after crimping of the other embodiment of the aerosol container of the present invention.
Figure 7B:
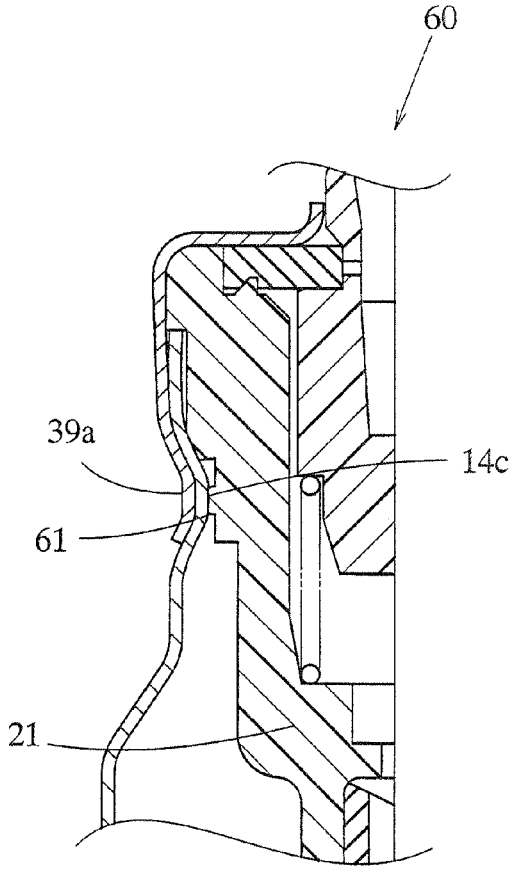

An aerosol container 60 of FIGS. 7*a, b* is that in which an annular rib 61 is formed on the surface 47 of the lower step portion 46 of the aerosol container 40 of FIG. 4*a*.

In this aerosol container 60, the top face 14*c* (the second portion) of the valve support portion 14 and the rib 61 contact strongly, forming the lower seal portion, by deforming the lower portion 39*a* of the cover cap inward. Moreover, same as the aerosol container 40 of FIG. 4*a*, the housing 21 does not become out of alignment when receiving external forces, since the housing 21 is fixed being pressed from above and below (upper support structure) and from a side face (lower support structure).

Figure 8A:
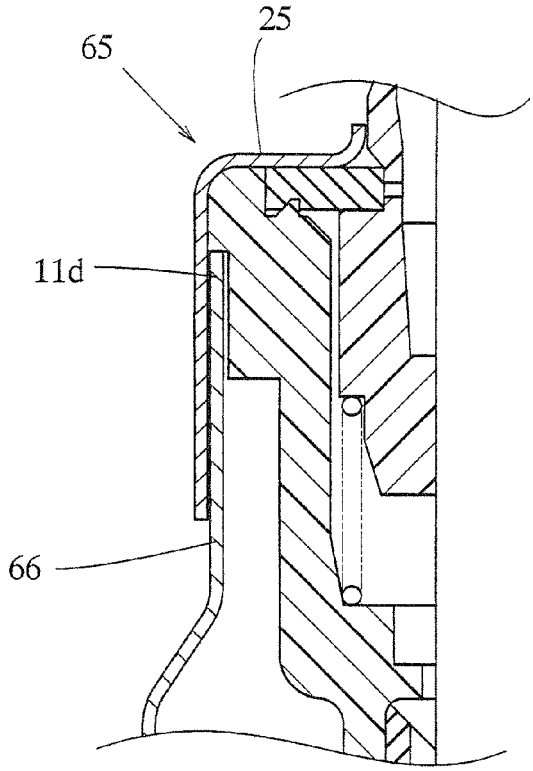
FIGS. 8*a, b* are partial side cross sectional views showing before and after crimping of the other embodiment of the aerosol container of the present invention.
Figure 8B:
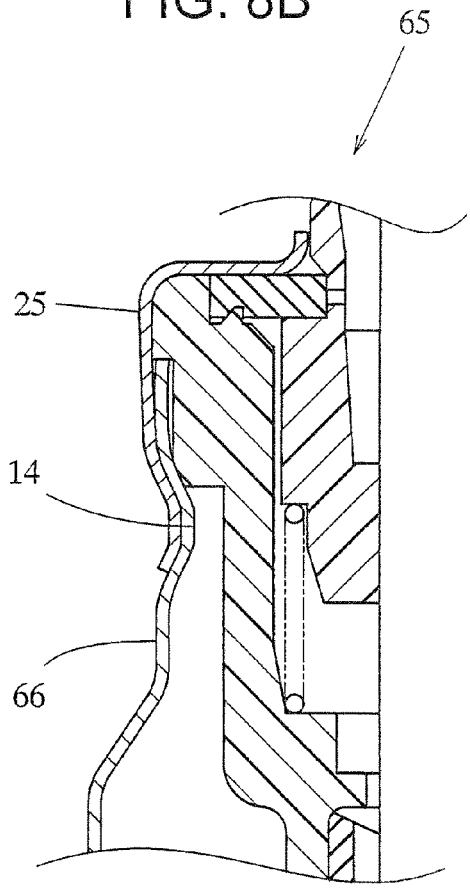

An aerosol container 65 of FIG. 8*a, b* is that in which a container body 66 is not equipped with the valve support portion 14 before the aerosol container is manufactured.

In this case, in the aerosol valve 12, the cover cap 25 is fixed to the container body 66, in a state that the flange portion of the housing is supported by the upper end 11*d* of neck portion. In other words, the lower portion 39*a* of the cover cap 25 is plastic deformed, while the valve portion 14 is formed in the container body 66. Thereby, aerosol container which is substantially same as the aerosol container 10 of FIG. 1 is manufactured. Thus, one of the manufacturing processes of the container body before manufacturing the aerosol container can be omitted, admitting cost reduction. Moreover, the distance from the valve support portion 14 to the top face of the cover cap 25 is not necessary to be managed.

Figure 9A:
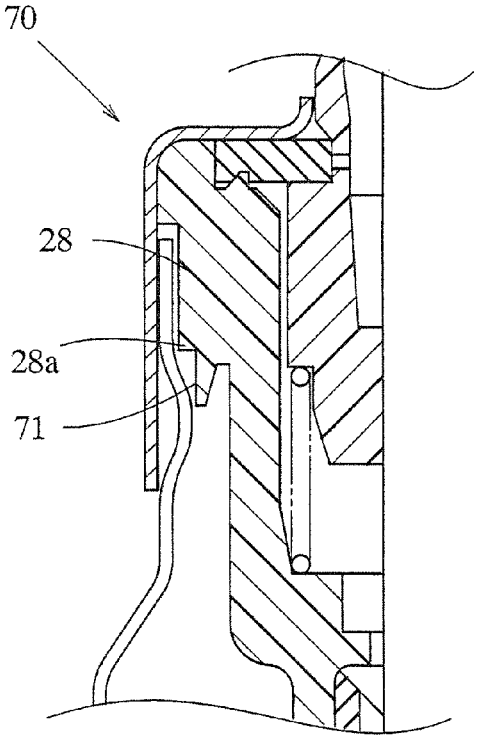
FIGS. 9*a, b* are partial side cross sectional views showing before and after crimping of the other embodiment of the aerosol container of the present invention.
Figure 9B:
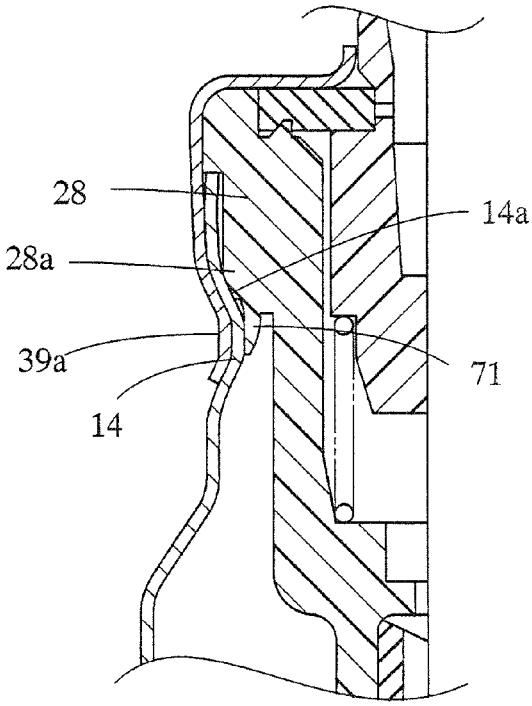
FIG. 9*c* is an extended figure of FIG. 9*b*.
FIG. 9*d* is an extended figure showing further the other embodiment of the aerosol container of the present invention.

An aerosol container 70 of FIGS. 9*a, b* has a tongue piece 71 which annually protrude downwardly and inside from the corner portion 28*a* is equipped in the lower face of the step portion 28.

Figure 9C:
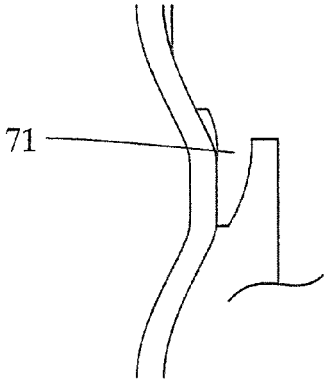

In the aerosol container 70, by plastic deforming the lower portion 39*a* of the cover cap inward, the upper inclined plane 14*a* of the valve support portion deforms the corner portion 28*a* of the step portion 28, and the valve support portion 14 elastically deforms the tongue piece 71. Thereby, not only the seal (seal portion) of the corner portion 28*a*, but also the sealing structure (lower seal) between the tongue piece 71 and the top of the valve support portion 14 can be obtained. FIG. 9*c* is an extended figure of the tongue piece 71. In this configuration, a sealing structure by elastic deformation can be obtained, therefore when housing become out of alignment, the tongue piece elastically deforms according to the misalignment, and the sealing property can be maintained.

Figure 9D:
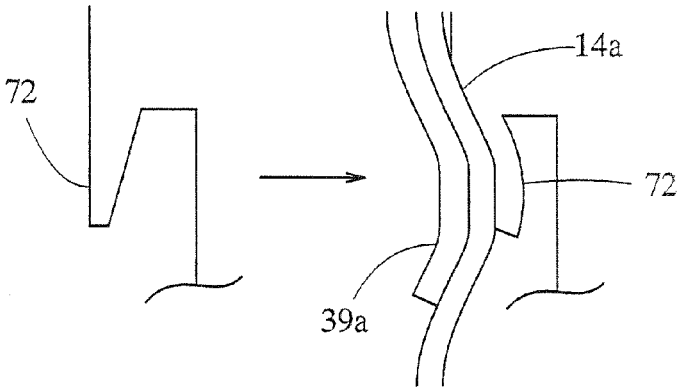

FIG. 9*d* is that in which a tongue piece 72 is formed on the corner portion of the step portion. In this configuration, a surface contact between the tongue piece 72 and the upper inclined plane 14*a* is formed constituting a sealing structure can be obtained, since the tongue piece 72 is elastically deformed along the upper inclined plane 14*a*, by plastic deforming the lower portion 39*a* of the cover cap. In this case, the contact area becomes large giving a high sealing property.

Figure 10A:
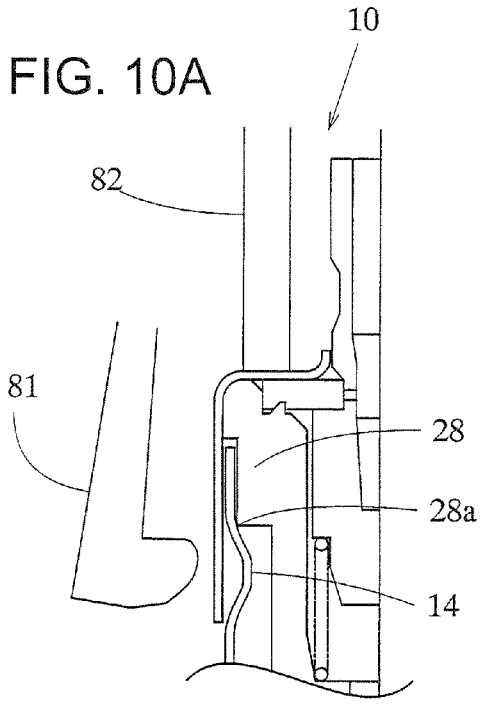
FIGS. 10*a, b* are outline drawings showing the manufacturing process of the aerosol container of FIG. 1, FIGS. 10*c, d* are outline drawings showing the manufacturing process of the aerosol container of FIG. 6.

In the next FIGS. 10*a, b*, a manufacturing device to manufacture the aerosol container 10 of FIG. 1 is described.

The reference numeral 81 in the figure is a crimp claw, the reference numeral 82 is a support rod. The crimp claw 81 plastically deforms the lower portion 39*a* of the cover cap, and simultaneously deforms the corner portion 28*a* of the step portion 28. Plurality of the crimp claw 81 is arranged annularly at an equal interval, so the corner portions 28*a* and the valve support portions 14 can form an annular seal. The support rod 82 presses the cover cap 25 downward, and a plurality of the support rod 82 is arranged cylindrically or annularly at an equal interval.

Figure 10B:
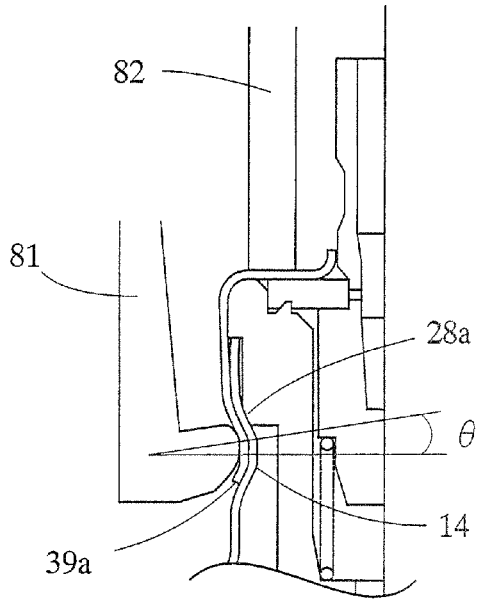
FIG. 10*e* is an outline drawing showing the other manufacturing process of the aerosol container of FIG. 6.

As shown in FIG. 10*b*, the crimp claw 81 is set so that when it deforms the lower portion 39*a* of the cover cap, its radial inward force faces more upward than horizontal as large as an angle θ. Moreover, the front edge shape of the crimp claw is a convex surface shape. Thereby the upper inclined plane 14*a* of the valve support portion depressed from the lower portion of 39*a* of the cover cap deforms the corner portion 28*a* into a curved surface shape, obtaining a preferable contact area constituting a seal structure.

Figure 10C:
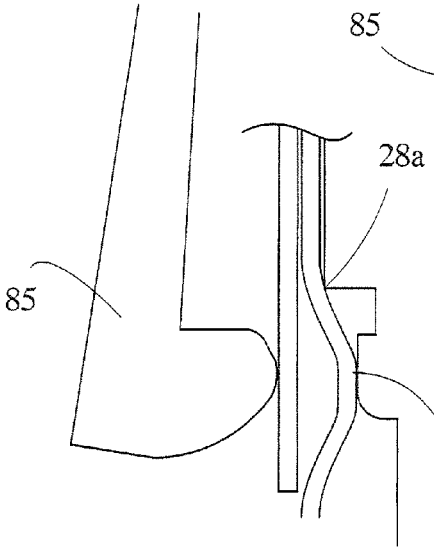

FIGS. 10*c, d* show a process to manufacture the aerosol container 55 of FIG. 6 using a crimp claw 85.

Figure 10D:
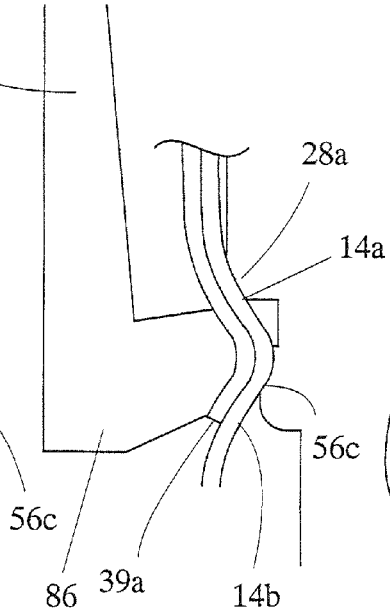

The seals are constituted between the upper inclined plane 14*a* of the valve support portion and the corner portion 28*a* of the step portion 28, and between the lower inclined plane 14*b* of the valve support portion and a corner portion 56*c* of an upper step portion 56*a*, by plastic deforming the lower portion 39*a* of the cover cap. In the crimp claw 85, the front edge of a claw portion 86 is dimensioned so as to be insertable between the step portion 28 and a protruding portion 56, and set so that the radial inward force of the upper portion of the front edge faces more upward than horizontal as large as an angle θ, and the lower portion of the front edge composes an inclined plane so as to expand downward. Since being constituted thus, the front edge deforms the corner portion 28*a* of the step portion 28 and the corner portion 56*c* of the upper step portion 56*a* (refer to FIG. 10*d*).

Figure 10E:
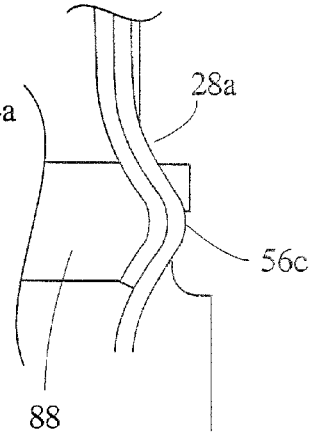

FIG. 10*e* is an outline drawing of manufacturing the aerosol container 55 of FIGS. 6*a, b*. By thus inserting the front edge of a roller 88 between the step portion 28 and the protruding portion 56, the corner portion 28*a* of the step portion 28 and the corner portion 56*c* of the upper step portion 56*a* may be deformed.

The invention claimed is:

1. A sealing structure of an aerosol container, comprising:

a container body having a cylindrically shaped opening;

a tubular housing fixed to the opening;

and a cup-shaped cover cap fixed to the container body covering the housing, wherein the housing has an annular step portion and a second step portion situated below the step portion, the cover cap has a deformed portion on a lower part, the deformed portion is plastically deformed inwardly, the container body has a first portion which comes into contact with the step portion and a second portion which comes in contact with the second step portion, wherein the contact of the second step portion and the second portion constitute a lower holding structure, wherein a circular seal portion is formed between the first portion and the step portion, and the seal portion is formed by deforming a corner portion of the step portion by pressing the first portion when forming the deformed portion while pushing the cover cap downward against the housing, wherein the second step portion has a smaller diameter than the step portion, and the second portion of the container body comes in contact with the surface of the second step portion.

2. A sealing structure according to claim 1, wherein the corner portion of the step portion is deformed into a curved surface shape which makes an area contact with the first portion from a square shape which makes a line contact with the first portion.

3. A sealing structure according to claim 1, wherein the housing has a flange portion engaging with an upper end portion of the container body constituting the opening, and the flange portion constitutes an upper holding structure clamped between the upper end portion of the container body and an inner bottom face of the cover cap.

4. A sealing structure according to claim 3, wherein a lower face of the flange portion inclines downwardly toward outside.

5. A sealing structure according to claim 1, wherein a rib is provided annularly on a surface of the second step portion, and the second portion deforms the rib by pressing.

6. A sealing structure according to claim 1, wherein the second step portion is a plurality of longitudinal ribs provided annually, the second portion deforms the longitudinal rib by pressing.

7. A sealing structure according to claim 1, wherein the second portion comes in contact with the corner portion of the second step portion.

8. A sealing structure according to claim 7, wherein the second portion deforms the corner portion of the second step portion.

9. A sealing structure according to claim 1, wherein the second step portion is a tongue piece extending downward and formed on an inner side than the corner portion of the step portion, and the corner portion and the tongue piece are deformed by coming in contact with the container body.

10. A sealing structure according to claim 1, wherein a contact line coming in contact with the housing by at least two points does not include the step portion.

11. A sealing structure according to claim 10, wherein the housing has a flange portion engaging with the upper end portion of the container body constituting the opening, and a side surface of the housing has a protrusion protruding outward in a radial direction, the protrusion constitute a contact line with a lower end periphery of the flange portion.

12. A sealing structure according to claim 1, wherein a synthetic resin layer is provided at least on an inside face of the opening of the container body.

13. A sealing structure according to claim 1, wherein the housing is made of polyolefin.

14. An aerosol container equipped with the sealing structure according to any one of claims 1-13, comprising:

the container body and an aerosol valve fixed to the opening of the container body, wherein the aerosol valve has the housing, a stem housed in the housing with free vertical movement, a spring which always energizes the stem upwardly, a stem rubber which plugs the stem hole of the stem, and the cover cap.

15. A method for manufacturing the aerosol container according to claim 14, comprising the steps of:

deforming the corner of the step portion into a curved surface shape from a square shape, by applying a force annually to the step portion from a convex surface by plastically deforming the lower part of the cover cap and a part of the container body while pushing the cover cap downwardly.

16. A method for manufacturing the aerosol container according to claim 15, wherein the housing has an annular second step portion beneath the step portion, forming the lower holding structure between the second portion and the second step portion of the container body, simultaneously with the plastic deformation of the step portion.

17. A sealing structure of an aerosol container, comprising:

a container body having a cylindrically shaped opening;

a tubular housing fixed to the opening;

and a cup-shaped cover cap fixed to the container body covering the housing, wherein the housing has an annular step portion and a second step portion situated below the step portion, the cover cap has a deformed portion on a lower part, the deformed portion is plastically deformed inwardly, the container body has a first portion which comes into contact with the step portion and a second portion which comes in contact with the second step portion, wherein the contact of the second step portion and the second portion constitute a lower holding structure, wherein a circular seal portion is formed between the first portion and the step portion, and the seal portion is formed by deforming a corner portion of the step portion by pressing the first portion when forming the deformed portion while pushing the cover cap downward against the housing, and wherein an annular flange portion is formed on an upper periphery of the housing, the annular flange portion being arranged on and in contact with a top of the container body.

* * * * *